United States Patent [19]

Weiner

[11] 4,143,857

[45] Mar. 13, 1979

[54] SAFETY/PRIVACY FENCE

[76] Inventor: Robert I. Weiner, 4 Chartwell Ct., Owings Mills, Md. 21117

[21] Appl. No.: 787,585

[22] Filed: Apr. 14, 1977

[51] Int. Cl.[2] ..... E04H 17/00

[52] U.S. Cl. ..... 256/11; 256/24; 292/58; 16/153

[58] Field of Search ..... 256/24, 21, 25, 73, 256/11; 52/626, 673; 292/57, 58, 60; 49/394; 16/153

[56] References Cited

U.S. PATENT DOCUMENTS

| | | | |
|---|---|---|---|
| 191,603 | 5/1877 | Lauckhardt | 256/11 |
| 1,793,013 | 2/1931 | Robertson | 16/153 |
| 3,034,610 | 5/1962 | Lynch | 256/25 X |
| 3,157,255 | 11/1964 | Sondheim | 256/24 X |
| 3,339,955 | 9/1967 | Leonard | 292/60 |

FOREIGN PATENT DOCUMENTS

| | | | |
|---|---|---|---|
| 3075 of | 1870 | United Kingdom | 256/21 |

*Primary Examiner*—Andrew V. Kundrat
*Attorney, Agent, or Firm*—Colton & Stone, Inc.

[57] ABSTRACT

A fence which provides an effective barrier to the attempts of children to climb and which is of durable and attractive appearance is formed of molded or stamped panels connected to support posts and a fence cap interlocking with the upper ends of the panels. Openings to reduce wind loading on the fence are provided in the panels and are configured so as not to provide hand or foot holds for children. A self-closing gate with a child-resistant latch is also provided.

14 Claims, 13 Drawing Figures

FIG. 10
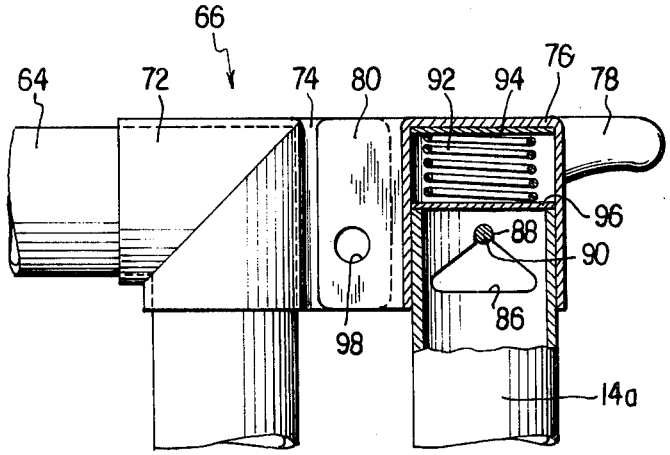
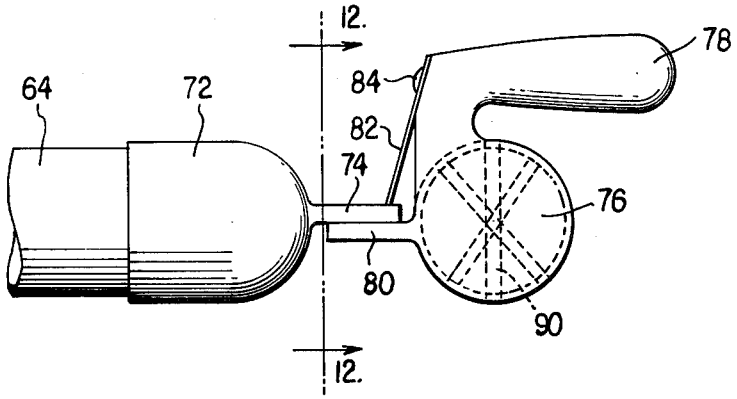
FIG. 11
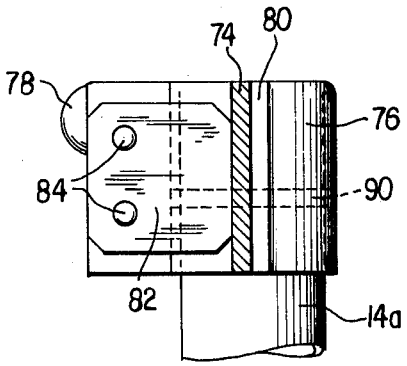
FIG. 12
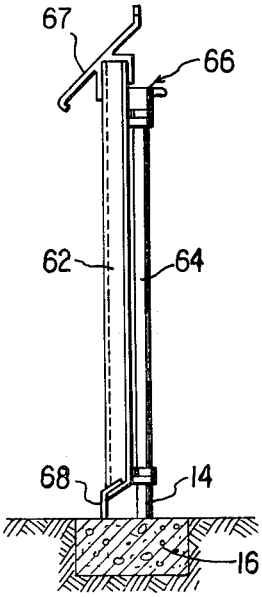
FIG. 13

SAFETY/PRIVACY FENCE

BACKGROUND OF THE INVENTION

The present invention relates broadly to fences and, in the preferred embodiment, to a swimming pool protective fence.

Swimming pool protective enclosures range from solid walls to woven wire and chain link fences, the latter being widely used because they are relatively inexpensive, easily installed and generally requiring little maintenance. These fences are not, however, entirely suited for this use as even very young children are capable of climbing such fences.

It is the primary object of the present invention to provide a fence construction which has the advantages of low cost, ease of installation, and which forms an effective barrier for young children.

BRIEF SUMMARY OF THE INVENTION

The above and other objects and advantages of the invention which will become apparent hereinafter are achieved by the provision of a fence the principal elements of which are panels formed of plastic, fiberglass or stamped metal, having vertically elongated openings to reduce wind loading, the lower ends of the openings tapering to a V-shaped configuration with a stress relief bottom radius, so as not to provide hand or foot holds for children; a top rail with a sloping surface which terminates in a serrated upper edge, again not providing a convenient hand hold for a child; and supporting posts. A self-closing gate with a child-resistent latch is also provided.

For a more complete understanding of the invention and the objects and advantages thereof, reference should be had to the following detailed description and the accompanying drawings wherein there is disclosed a preferred embodiment of the invention.

BRIEF DESCRIPTION OF THE DRAWINGS

In the drawings:

FIG. 10 is a fragmentary elevational view of the gate latch mechanism;

FIG. 11 is a plan view of the latch mechanism;

FIG. 12 is a fragmentary transverse sectional view taken along the line 12—12 of FIG. 11; and FIG. 13 is a transverse sectional view taken along the line 13—13 of FIG. 6.

DETAILED DESCRIPTION OF THE PREFERRED EMBODIMENT

Figure 2:
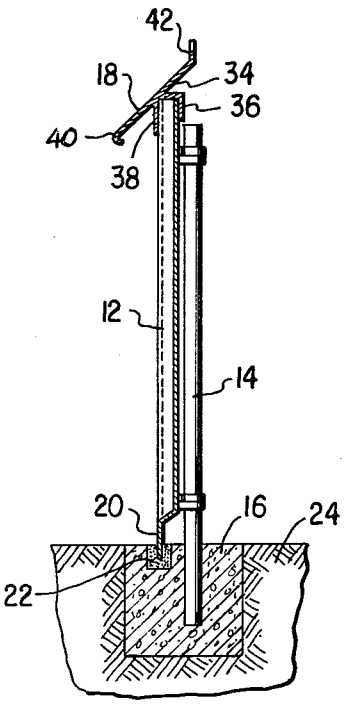
FIG. 2 is a transverse sectional view taken along the line 2—2 of FIG. 1.

Referring first to FIGS. 1 through 5, the fence of the present invention is designated generally by the reference numeral 10. The principal components of the fence 10 are panels 12, support posts 14 embedded in concrete footings 16, and a top rail or fence cap 18. In a typical installation, the posts 14 are placed at eight feet center-to-center spacing while each panel 12 is seven feet nine inches in length and four feet in height. Each panel 12 has alternate ribs 26 and recessed portions 28, the faces of the ribs 26 being flush with a lower flange 20. In order to minimize wind loading on the fence, the recessed portions 28 of the panels are formed or provided with openings 30. As can be seen from FIG. 1, the openings 30 have large radiused upper ends with the sides of the openings tapering together to terminate in a small radiused lower end 32. This configuration is an effective deterent to attempts by young children to climb the fence as the openings do not provide any hand or foot holds for children.

Figure 1:
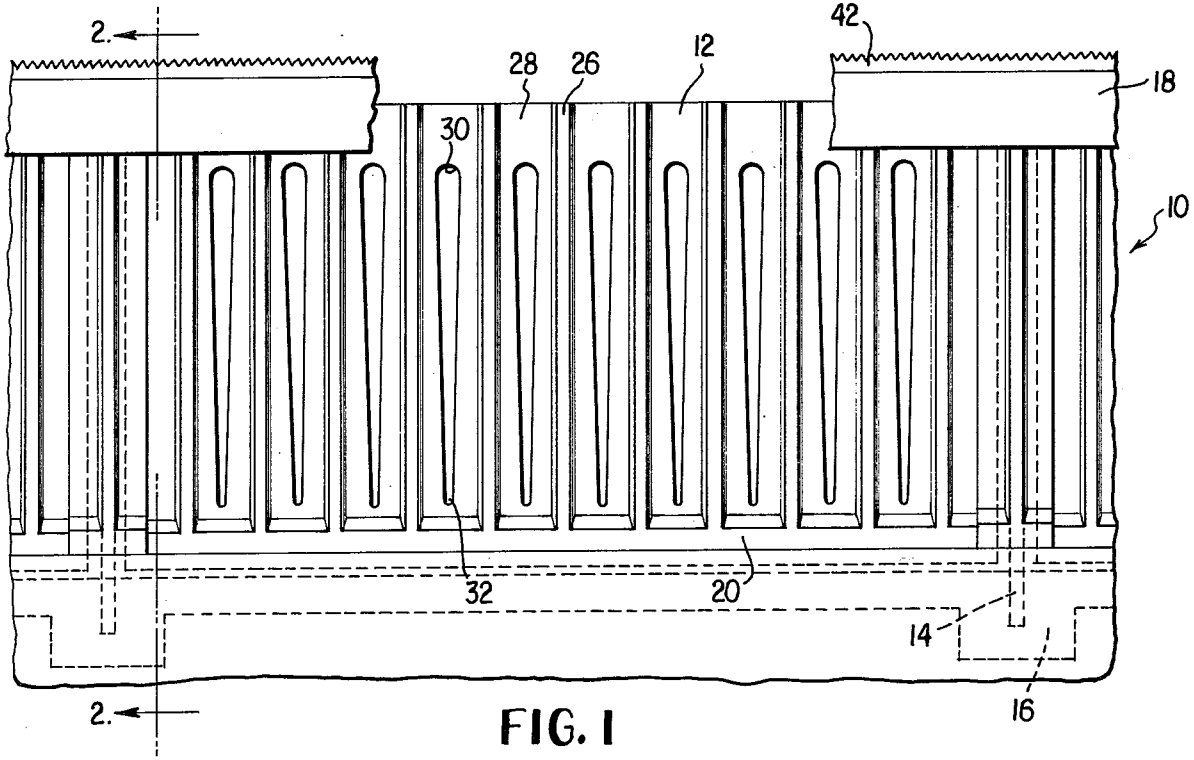
FIG. 1 is a fragmentary front elevational view, with portions broken away for clarity, of the fence of the present invention.

The fence cap 18 is shown most clearly in FIGS. 1 and 2, The cap 18 has a sloping center section 34 which, in a typical installation, may be one foot wide. A pair of ribs 36, 38 project downwardly from the bottom face of the center section to form a continuous channel which receives the upper edge portion of the fence panels 12. The interlocking of the fence cap and the panels in this manner imparts rigidity to the panels, thus allowing a large span between adjacent support posts with a lightweight construction. If the lower flange 20 of the panel is embedded in the concrete footing 16, the rigidity of the panels is further increased.

The lower edge 40 of the fence cap center section 34 returns inwardly to provide a smooth edge. The upper edge 42 of the center section extends upwardly and terminates in a serrated edge. The serrated edge serves to discourage use of the top of the fence as a hand hold.

The panels 12 may be formed of fiberglass, polystyrene or other plastics as these materials lend themselves to rapid and economical production, are highly durable and may be colored or otherwise decorated to provide an attractive appearance. Alternatively, they may be formed of galvanized sheet metal or aluminum. If the panels are formed of metal, the edges of the openings 30 are rolled or otherwise finished so as to avoid sharp edges. The fence cap 18 may also be formed of plastic or metal. Galvanized iron pipes may be used as the support posts 14.

Figure 3:
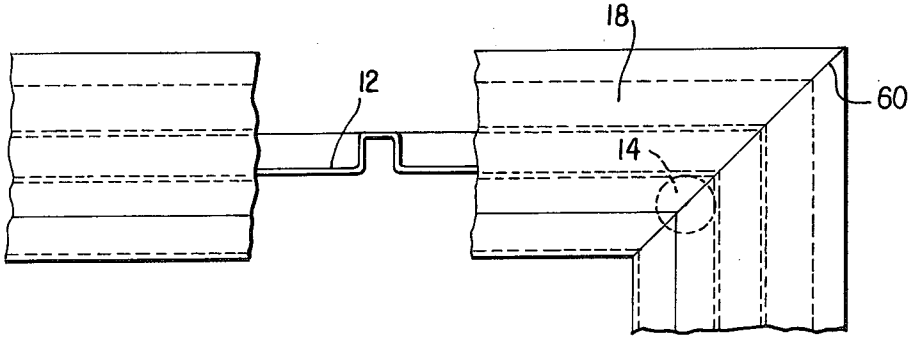
FIG. 3 is a fragmentary plan view of the fence.
Figure 4:
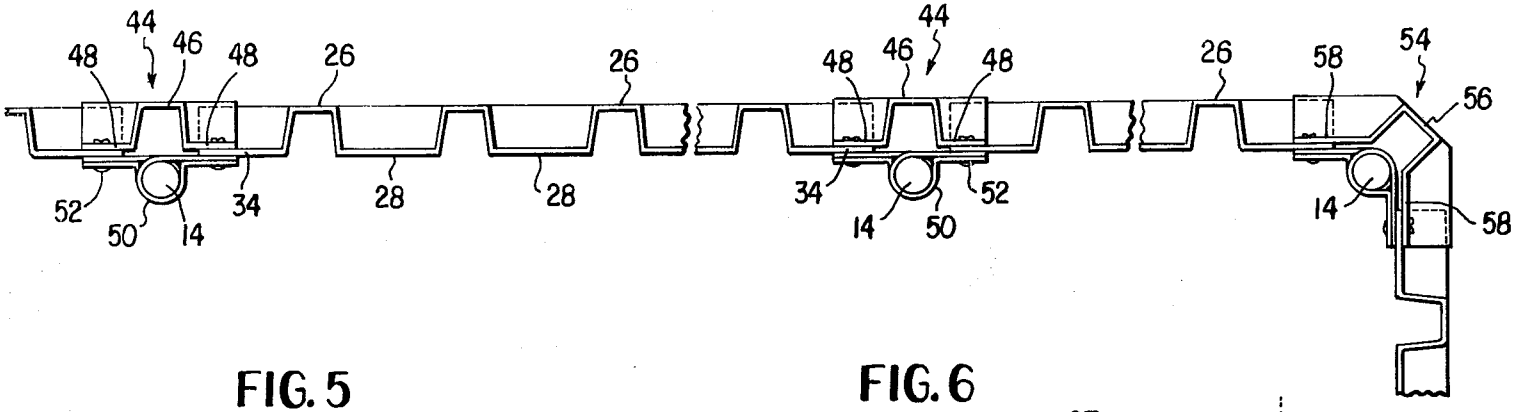
FIG. 4 is a view similar to that of FIG. 3 but with the fence cap removed.
Figure 6:
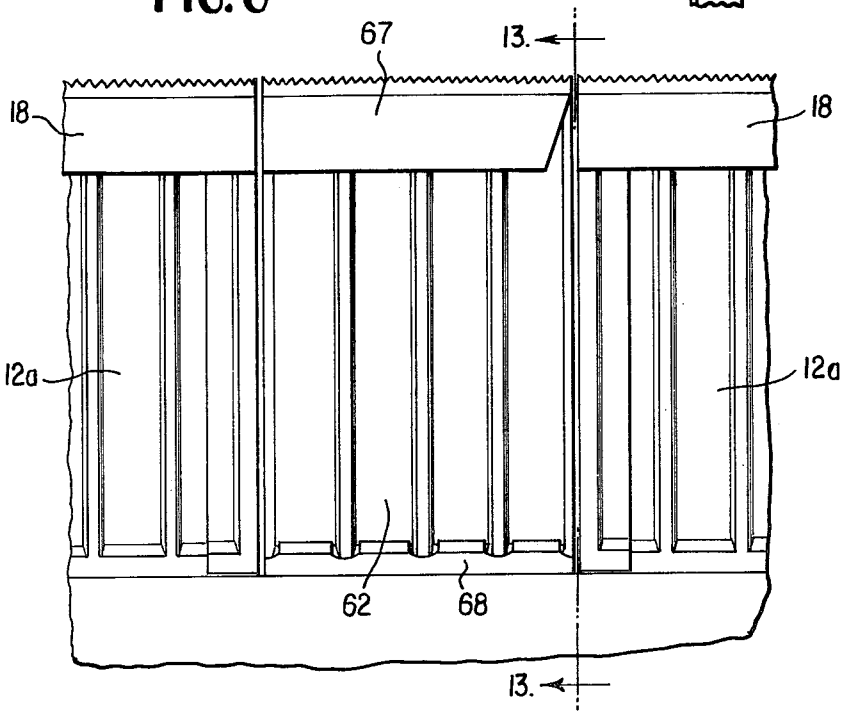
FIG. 6 is a fragmentary front elevational view of a section of the fence including a gate.
Figure 5:
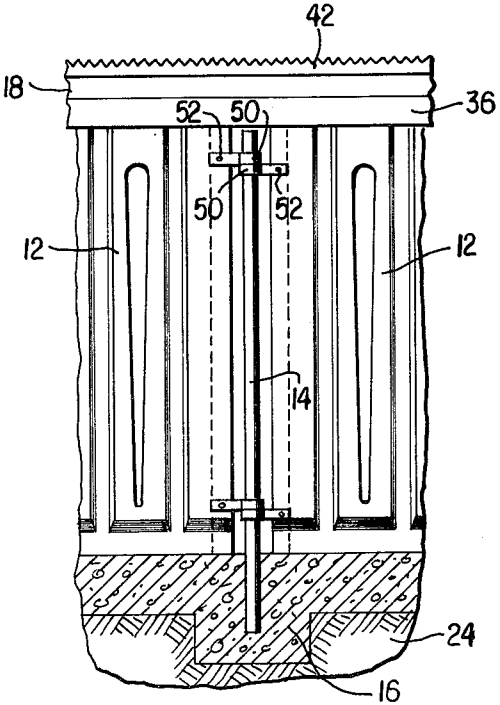
FIG. 5 is a fragmentary rear elevational view illustrating the manner in which the fence panels are secured to the support posts.

The manner in which the individual panels 12 are assembled to form a complete enclosure can be seen from FIGS. 3, 4, and 5. The posts 14 are first installed at uniformly spaced intervals such that a single panel spans the distance between adjacent posts. Each panel is connected to its support post by post encircling clips 50 and rivets or other fasteners 52. At the straight line joints between panels, cover plates 44 are employed to mask the panel ends and the posts 14, the plate 44 having central ribs 46 which correspond to the ribs 26 of the panels 12 and lateral flanges 48 which are secured to the fence by the rivets 52. An outside corner cover plate 54 is also shown in FIG. 4 and has a center rib 56 and wide lateral flanges 58. Although not illustrated, a cover plate is also employed on inside corners. The fence cap 18 extends continuously along the fence and is mitered at corners as is indicated by the reference numeral 60.

FIGS. 6 through 13 illustrate the gate and its hinge and latch mechanisms. The gate includes a panel 62 having the same configuration as the fence panels 12 except for the absense of openings 30 and a lower flange 20. The panel is carried by a frame formed of pipe lengths. Support posts 14 are located at either side of the gate and a latch mechanism 66 and a hinge assembly 70 connect the gate to these posts. Preferably, the fence panels adjacent the gate are modified panels 12*a* in which the recessed portions nearest the gate do not have openings. The top of the gate panel 62 is provided with a section of the fence cap 67. Optionally, a flexible skirt 68 may be provided along the lower edge of the gate panel 62.

Figure 8:
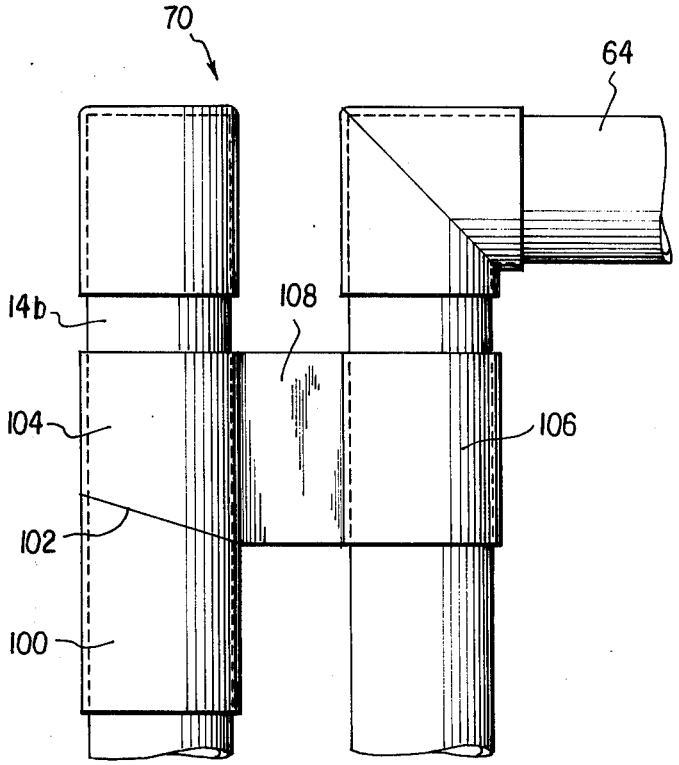
FIG. 8 is a fragmentary elevational view of the hinge employed with the gate of the fence.
Figure 9:
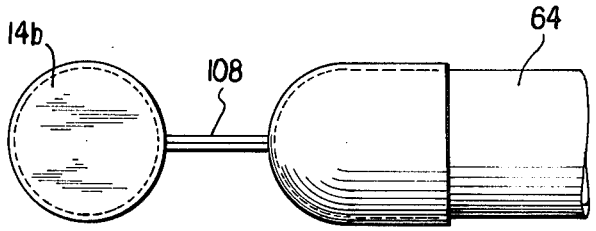
FIG. 9 is a fragmentary plan view of the hinge.

FIGS. 8 and 9 illustrate the gravity hinge 70 employed with the gate. A first collar 100 is affixed to the support post 14 and has an inclined upper end 102. A second collar 104 of complementary configuration at its lower end is free to rotate on the post 14 and is connected to a collar 106 attached to the gate frame 64 by a hinge leaf 108. The surface 102 functions as a camming surface, causing the gate to close automatically by gravity.

The child-resistent latch mechanism 66 is illustrated in FIGS. 10, 11, and 12. The upper corner of the fence frame 64 at the latch side of the gate has an elbow 72 which has a plate-like member 74 projecting outwardly to the side of the gate. The member 74 serves as a latch bar. The top cap 76 of the adjacent post 14 has a handle 78 projecting to one side and a second plate-like member 80 projecting toward the gate and mating with the latch bar 74. A spring plate 82 is riveted to the handle 78 and, when the gate is in its closed position, holds the latch bar 74 against the latch bar 80. The top cap 76 is connected to the upper end of the post 14 by a connection which permits limited rotation of the cap 76. Diametrically located openings 86 are provided in the post 14, these openings being generally triangular and having an upper apex extending into a notch 88. A pin 90 held by the cap 76 passes through the openings 86, the pin normally being located in the notch 88, a coil spring 92 bearing between washers 94 and 96 biasing the cap 76 upwardly and the inclined walls of the opening 86 camming the pin toward the notch 88. Holes 98 in the latch bars 74 and 80 allow the gate to be padlocked, when desired.

Figure 7:
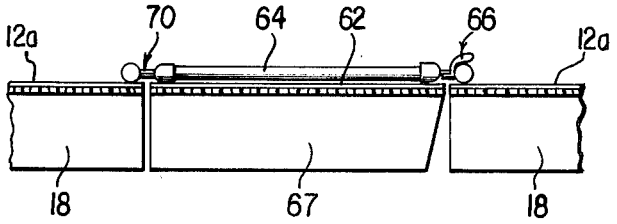
FIG. 7 is a fragmentary plan view of the section of the fence illustrated in FIG. 6.

The operation of the latch mechanism 66 will now be described. The normal position of the cap 76, i.e., that in which the pin 90 is in the notch 88, is shown in FIGS. 7 and 11. When the gate is closing, the end of the latch bar 74 contacts the face of spring plate 82, causing the spring plate to bend toward the cap 76 until the gate latch bar passes the free end thereof. At this point, the spring plate 82 returns to its normal position and the latch bar 74 is held between the free end of the plate and the cap latch bar 80, as shown in FIGS. 11 and 12. In order to unlatch the gate, the top cap 76 must first be depressed against the spring 92 to move the pin 90 clear of the notch 88 and then rotated in the clockwise direction, when viewed as in FIG. 11. Since the handle must be rotated while being depressed against the pressure exerted by the spring 92, this operation is difficult for children to perform and is thus a safety feature. As the handle and cap are rotated, the latch bar 80 pushes against the gate latch bar 74 and the gate rotates counterclockwise about its hinges until the end of the latch bar 74 is clear of the spring plate 82 and the gate is unlatched.

From the above description of a preferred embodiment of the invention it will be apparent that a fence construction is provided which is particularly suitable for use as a privacy and security fence for enclosing a swimming pool. The lack of hand holds eliminates the danger that a young child might climb over the fence. Since the gate is self-closing, it can not be inadvertently left open. The latch mechanism provides an additional safety feature.

While only a single embodiment of the invention has been illustrated and described in detail herein, it will be understood that the invention is not limited thereto or thereby. Rather, reference should be had to the appended claims in determining the true scope of the invention.

I claim:

1. A fence construction, comprising:

a plurality of panels each having alternate rib sections and recessed sections, at least certain of said sections each having a vertically elongated opening defined by downwardly converging sides connected at their upper ends by a large radius and at their lower ends by a small radius, the width of the lower end of said opening and the angle of convergence of the sides thereof being such as not to provide a hand or foot hold for a child;

a plurality of support posts;

connecting means for securing said panels to said posts; and a fence cap member having a continuous, downwardly opening channel adapted to fit securely along the upper edge of each said panel along the length thereof.

2. The fence construction of claim 1 wherein said fence cap member has a sloping principal surface the upper end of which terminates in a serrated edge and the lower end of which terminates in a rounded edge, said channel extending downwardly from the lower face of said principal surface intermediate the upper and lower edges thereof.

3. The fence construction of claim 1 wherein the lower end of each of said panels includes a flange extending the length of said panel and having a principal surface coplanar with the face of said ribs.

4. The fence construction of claim 3 wherein said panels and said fence cap member are formed of molded fiberglass.

5. The fence construction of claim 1 further including a gate assembly, said assembly including a frame, a gate panel supported by said frame, a pair of support posts located at opposite sides of said frame and each connected to one end of the adjacent fence panel, hinge means connecting one side of said frame to one of said pair of support posts, and a child-resistant latch connecting the opposite side of said frame to the other of said pair of support posts.

6. A fence construction comprising:

a plurality of panels each having alternate rib sections and recessed sections, at least certain of said sections each having a vertically elongated opening the side walls of which converge downwardly at a sufficiently steep angle as not to provide a hand or foot hold for a child, the lower end of each of said panels including a flange extending the length of said panel and having a principal surface coplanar with the face of said ribs, sad flange being adapted to have its lower edge embedded below the surface of the ground adjacent said fence construction;

a plurality of support posts;

connecting means for securing said panels to said posts; and a fence cap member having a continuous, downwardly opening channel adapted to fit securely along the upper edge of each said panel along the length thereof.

7. A fence construction comprising:

a plurality of panels each having alternate rib sections and recessed sections, at least certain of said sections each having a vertically elongated opening the side walls of which converge downwardly at a sufficiently steep angle as not to provide a hand or foot hold for a child;

a plurality of support posts;

connecting means for securing said panels to said posts;

a fence cap member having a continuous, downwardly opening channel adapted to fit securely along the upper edge of each said panel along the length thereof; and a gate assembly including a frame, a gate panel supported by said frame, a pair of support posts located at opposite sides of said frame and each connected to one end of the adjacent fence panel, hinge means connecting one side of said frame to one of said pair of support posts, and a child-resistant latch, said latch comprising a first latch bar rigidly connected to said frame and projecting toward the other of said support posts and cooperating latch means carried by said lastmentioned support post and rotatable thereabout, said cooperating latch means including a second latch bar projecting toward said gate and abutting one side face of said first latch bar when said gate is in its closed position, a spring plate adapted to contact the opposite side face of said first latch bar when said gate is in its closed position, and spring-loaded detent means bearing said cooperating latch means toward the latched position.

8. The fence construction of claim 7 wherein said lastmentioned support post includes diametrically opposed openings adjacent the upper end thereof, each said opening being of generally triangular configuration the apex of which extends into a notch, said cooperating latch means including a cap-like member fitting over the top of said lastmentioned support post, a pin passing through said cap-like member and said openings, and spring means acting between said lastmentioned support post and said cap-like member to bias said member upwardly whereby said pin is biased into said notch.

9. In a fence construction of the type having support posts and panels extending between and connected to adjacent ones of said posts, the improvement wherein said panels have vertically elongated openings therein defined by downwardly converging sides connected at their upper ends by a large radius and at their lower ends by a small radius, the width of the lower end of said opening and the angle of convergence of the sides thereof being such as not to provide a hand or foot hold for a child.

10. The improvement of claim 9 wherein each of said panels has a continuous, planar lower section and an upper section having alternate ribs coplanar with said lower section and recessed sections, said vertically elongated openings being provided in said recessed sections.

11. The improvement of claim 10 further including a fence cap member having a continuous, downwardly opening channel adapted to fit securely along the upper edge of said upper section of said panel along the length thereof.

12. The improvement of claim 11 wherein said fence cap member has a sloping principal surface the upper end of which terminates in a serrated edge and the lower end of which terminates in a rounded edge, said channel extending downwardly from the lower face of said principal surface intermediate the upper and lower edges thereof.

13. In conjunction with a fence having support posts, fence panels connected to said support posts, and a gate hinged to one of said support posts, a latch mechanism connecting said gate to a second one of said support posts, said latch mechanism comprising:

a first latch bar rigidly connected to said gate and projecting toward said second of said support posts and cooperating latch means carried by said lastmentioned support post and rotatable thereabout, said cooperating latch means including a second latch bar projecting toward said gate and abutting one side face of said first latch bar when said gate is in its closed position, a spring plate adapted to contact the opposite side face of said first latch bar when said gate is in its closed position, and spring-loaded detent means biasing said cooperating latch means toward the latched position.

14. The mechanism of claim 13 wherein said lastmentioned support post includes diametrically opposed openings, adjacent the upper end thereof, each said opening being of generally triangular configuration the apex of which extends into a notch, said cooperating latch means including a cap-like member fitting over the top of said lastmentioned support post, a pin passing through said cap-like member and said openings, and spring means acting between said lastmentioned support post and said cap-like member to bias said member upwardly whereby said pin is biased into said notch.

* * * * *